US008295732B2

(12) United States Patent
Nakano

(10) Patent No.: US 8,295,732 B2
(45) Date of Patent: Oct. 23, 2012

(54) ELECTROPHOTOGRAPHIC PHOTOSENSITIVE MEMBER AND METHOD OF PRODUCING THE SAME

(75) Inventor: Kouichi Nakano, Hakusan (JP)

(73) Assignee: Kyocera Corporation, Kyoto (JP)

( * ) Notice: Subject to any disclaimer, the term of this patent is extended or adjusted under 35 U.S.C. 154(b) by 1114 days.

(21) Appl. No.: 11/771,394

(22) Filed: Jun. 29, 2007

(65) Prior Publication Data

US 2008/0003016 A1 Jan. 3, 2008

(30) Foreign Application Priority Data

Jun. 30, 2006 (JP) ..... 2006-182671

(51) Int. Cl.
*G03G 15/00* (2006.01)

(52) U.S. Cl. ..... 399/159; 430/127; 430/128

(58) Field of Classification Search ..... 399/159; 430/127, 128
See application file for complete search history.

(56) References Cited

U.S. PATENT DOCUMENTS

| | | | | |
|---|---|---|---|---|
| 5,151,737 | A * | 9/1992 | Johnson et al. | 399/117 |
| 5,362,588 | A * | 11/1994 | Yoshihara et al. | 430/69 |
| 5,518,854 | A * | 5/1996 | Yu et al. | 430/133 |
| 5,565,289 | A * | 10/1996 | Yoshihara et al. | 430/64 |
| 5,587,266 | A * | 12/1996 | Ujihara et al. | 430/133 |
| 5,853,936 | A | 12/1998 | Segi et al. | |
| 5,991,571 | A * | 11/1999 | Yamada et al. | 399/117 |
| 6,002,897 | A * | 12/1999 | Kohno et al. | 399/117 |
| 6,063,532 | A * | 5/2000 | Miyake | 430/56 |
| 6,253,044 | B1 * | 6/2001 | Shoji et al. | 399/111 |
| 6,391,394 | B1 * | 5/2002 | Shirasuna et al. | 427/569 |
| 6,711,368 | B2 * | 3/2004 | Ogasawara | 399/159 |
| 6,830,857 | B2 * | 12/2004 | Kabata et al. | 430/56 |
| 6,907,205 | B2 * | 6/2005 | Himes et al. | 399/90 |
| 7,232,635 | B2 * | 6/2007 | Kobayashi et al. | 430/122.1 |
| 7,618,759 | B2 * | 11/2009 | Nishimura | 430/69 |
| 7,759,034 | B2 * | 7/2010 | Nakano | 430/69 |
| 7,897,315 | B2 * | 3/2011 | Takemoto et al. | 430/69 |

(Continued)

FOREIGN PATENT DOCUMENTS

JP 60-154278 8/1985

(Continued)

OTHER PUBLICATIONS

English translation of Japanese publication by Ohira et al. (JP 2000-039729).*

(Continued)

*Primary Examiner* — David Gray
*Assistant Examiner* — Geoffrey Evans
(74) *Attorney, Agent, or Firm* — DLA Piper LLP (US)

(57) ABSTRACT

The present invention relates to an electrophotographic photosensitive member including a photosensitive layer formed on an outer circumferential surface of a cylindrical body. The cylindrical body includes a plurality of chamfers formed between an end surface and the outer circumferential surface. A chamfer arranged nearest an inner circumferential surface of the cylindrical body has a crossing angle of not less than 3° and not more than 25° relative to the end surface. The cylindrical body may include a recess formed between the end surface and the outer surface. The end surface may be formed to have pearskin. The present invention also relates to a method of manufacturing the electrophotographic photosensitive member. In the manufacturing method, a plurality of cylindrical bodies is supported by a supporting body in a manner that the end surfaces are positioned at contacting portions of adjacent cylindrical bodies.

10 Claims, 11 Drawing Sheets

U.S. PATENT DOCUMENTS

| | | | | |
|---|---|---|---|---|
| 8,023,867 | B2 * | 9/2011 | Takano et al. | 399/267 |
| 8,036,571 | B2 * | 10/2011 | Imanaka et al. | 399/115 |
| 8,057,975 | B2 * | 11/2011 | Nishimura | 430/69 |
| 8,126,360 | B2 * | 2/2012 | Kawasaki et al. | 399/116 |
| 8,137,878 | B2 * | 3/2012 | Fujiwara | 430/66 |
| 8,142,968 | B2 * | 3/2012 | Altavela et al. | 430/60 |
| 8,158,316 | B2 * | 4/2012 | Iwanaga et al. | 430/66 |
| 2007/0201895 | A1 * | 8/2007 | Nakano | 399/96 |
| 2008/0056763 | A1 * | 3/2008 | Nishimura | 399/159 |
| 2012/0114379 | A1 * | 5/2012 | Yamashita et al. | 399/159 |

FOREIGN PATENT DOCUMENTS

| | | | | |
|---|---|---|---|---|
| JP | 60133478 | A | | 9/1985 |
| JP | 62-71635 | | | 5/1987 |
| JP | 05011465 | A | * | 1/1993 |
| JP | 06167823 | A | | 6/1994 |
| JP | 06337534 | A | * | 12/1994 |
| JP | 08171223 | A | | 7/1996 |
| JP | 09003652 | A | | 1/1997 |
| JP | 09-297500 | | | 11/1997 |
| JP | 10-186698 | | | 7/1998 |
| JP | 10-198058 | | | 7/1998 |
| JP | 10198058 | A | | 7/1998 |
| JP | 2000-039729 | | | 2/2000 |
| JP | 2002-004050 | | | 1/2002 |
| JP | 2007171271 | A | | 7/2007 |

OTHER PUBLICATIONS

English translation of Japanese publication by Kugimiya (JP 06-167823).*

English machine translation of Japanese patent publication Kawase et al. (JP 06-337534).*

English machine translation of Japanese patent publication Kawase et al. (JP 06-337534), published Dec. 6, 1994.*

Notification of Reasons for Refusal (2008-198970) and English translation, (mailed Aug. 29, 2008).

Japanese language office action dated Apr. 5, 2011 and its English language translation for corresponding Japanese application 2008198969, (Application JP2008-198969 was filed Jul. 31, 2008, published Oct. 30, 2008.).

Japanese language office action and its English language translation for corresponding Japanese application 2006-182671, (The Japanese Office Action was mailed Aug. 5, 2008.) (Application JP2006-182671 was filed Jun. 30, 2006, published Jan. 24, 2008).

Japanese language accelerated examination situation description for corresponding Japanese application 2006-182671, (The Situation Description was filed Aug. 1, 2008.).

Japanese language accelerated examination situation description for corresponding Japanese application 2006-198970, (The Situation Description was filed Aug. 1, 2008.).

* cited by examiner

ELECTROPHOTOGRAPHIC PHOTOSENSITIVE MEMBER AND METHOD OF PRODUCING THE SAME

CROSS-REFERENCE TO RELATED APPLICATIONS

The present application claims priority under 35 U.S.C. §119 to Japanese Patent Application No. 2006-182671, filed Jun. 30, 2006, entitled "ELECTROPHOTOGRAPHIC PHOTOSENSITIVE MEMBER AND METHOD OF PRODUCING THE SAME." The contents of this application are incorporated herein by reference in their entirety.

BACKGROUND OF THE INVENTION

1. Field of the Invention

The present invention relates to an electrophotographic photosensitive member including a cylindrical body having an outer circumferential surface formed with a photosensitive member, and a method of manufacturing the same.

2. Description of the Related Art

Various types of electrophotographic photosensitive members are known, and the common type is in shape of a drum. The drum-shaped electrophotographic photosensitive member includes a cylindrical body having a surface formed with a desired layer such as a photoconductive layer made of amorphous silicon (hereinafter referred to as "a-Si"). Meanwhile, various types of methods for forming a-Si photoconductive layer on a cylindrical body are known. Among them, plasma CVD method is now being put into practical use. In the plasma CVD method, DC voltage, high frequency wave, or microwave is supplied to generate glow discharge for decomposing material gas, so that deposited film is formed on a cylindrical body.

In manufacturing an electrophotographic photosensitive member by such plasma CVD method, a glow discharge plasma CVD device 9 as shown in FIG. 11 is used (refer to JP-A-2002-004050, for example).

The illustrated glow discharge plasma CVD device 9 forms a-Si film, utilizing glow discharge plasma, on a cylindrical conductive body 91 positioned at a substantially central portion of a cylindrical vacuum vessel 90. In the glow discharge plasma CVD device 9, the conductive body 91 supported by a supporting body 92 via a ring 93 serves as a ground electrode. These components are concentrically surrounded by a cylindrical metal electrode 94 which has a hollow portion and serves as an electrode for applying high frequency power. The metal electrode 94 is provided with gas inlet ports 95 for introducing material gas for film forming. The material gas introduced from the gas inlet ports 95 is sprayed toward the conductive body 91 through gas outlet ports 94*a* provided at the inner circumferential surface of the metal electrode 94. A high frequency power source 96 applies high frequency power across the metal electrode 94 and the conductive body 91 to generate glow discharge. In the supporting body 92, a heating means 97 such as nichrome wire and a cartridge heater is provided for heating the conductive body 91 up to a desired temperature. The supporting body 92 and the conductive body 91 are rotated together by a rotation means 98 including a rotation motor 98*a*.

In forming a-Si film on the conductive body 91, material gas of a predetermined amount and gas ratio is introduced from the gas inlet ports 95 into the space between the metal electrode 94 and the conductive body 91 through the gas outlet ports 94*a*. Meanwhile, gas pressure in the vacuum vessel 90 is set to a predetermined amount by controlling discharge of gas from a gas discharge port 99 using a vacuum pump (not shown). Then, high frequency power is applied across the metal electrode 94 and the conductive body 91 by the high frequency power source 96, so that glow discharge plasma is generated across the metal electrode 94 and the conductive body 91 to decompose the material gas, whereby a-Si film is formed on the conductive body 91 set at a predetermined temperature. In film forming, since the conductive body 91 is rotated together with the supporting body 92 by the rotation means 98, the film is formed to have uniform thickness and property in the circumferential direction of the conductive body 91.

When forming a desired film on the conductive body 91 using the plasma CVD device 9, in order to improve the productivity, for example, as shown in FIG. 12, a plurality of conductive bodies 91 are supported by the supporting body 92 to be incorporated in the plasma CVD device 9, and film forming is performed simultaneously to the plurality of conductive bodies 91.

However, since the adjacent conductive bodies 91 contact each other at end surfaces 91A, gas components existing around the conductive bodies 91 are prevented from contacting the end surfaces 91A. Thus, in forming film on such conductive bodies 91, though the film is formed on the outer circumferential surface of the conductive bodies 91, deposited species is not properly attached to the end surfaces 91A. The deposited species failed to be attached to the end surfaces 91A becomes powdered material which may be attached to the outer circumferential surface of the conductive bodies 91 and exist as fine projections.

Such fine projections cause black spots which lead to image degradation in images formed by an image forming apparatus incorporating the electrophotographic photosensitive member. Therefore, the electrophotographic photosensitive member formed with fine projections must be disposed of as defective goods, which reduces the yield and thus prevents cost reduction, so that demand for lower price cannot be met.

Further, when the end surfaces 91A are not formed with deposited film, adhesion of the film is deteriorated at the end portions of the adjacent conductive bodies 91. Thus, when removing the conductive bodies 91 from the supporting body 92 after film forming, the film may peel off from the end portions of the conductive bodies 91. Such peeling off of the film from the end portions also reduces the yield.

SUMMARY OF THE INVENTION

An object of the present invention is to manufacture an electrophotographic photosensitive member with increased yield, by forming film on a cylindrical body with few defects such as fine projections, and by preventing peeling of the film.

The present invention relates to an electrophotographic photosensitive member comprising a cylindrical body and a photosensitive layer formed on an outer circumferential surface of the cylindrical body.

The present invention further relates to a method of manufacturing the electrophotographic photosensitive member, comprising a first step for supporting a plurality of cylindrical bodies by a supporting body, and a second step for forming a photosensitive layer on an outer circumferential surface of the cylindrical body.

Each of the cylindrical bodies includes one chamfer, or a plurality of chamfer connected to each other, formed between an end surface and the outer circumferential surface. The chamfer which is closest to an inner circumferential surface of the cylindrical body has a crossing angle of not less than 3° and not more than 25° relative to the end surface.

When using such cylindrical body, in the first step of the manufacturing method according to the present invention, the cylindrical bodies are supported by the supporting body in a manner that the chamfers are positioned at contacting portions of adjacent cylindrical bodies.

The cylindrical body may include a recess formed between an end surface and the outer circumferential surface.

When using such cylindrical body, in the first step, the cylindrical bodies are supported by the supporting body in a manner that the recesses are positioned at contacting portions of adjacent cylindrical bodies.

The cylindrical body may include an end surface roughened to have pearskin.

When using such cylindrical body, in the first step, the cylindrical bodies are supported by the supporting body in a manner that the respective end surfaces are positioned at contacting portions of adjacent cylindrical bodies.

DETAILED DESCRIPTION OF THE PREFERRED EMBODIMENTS

Figure 1:
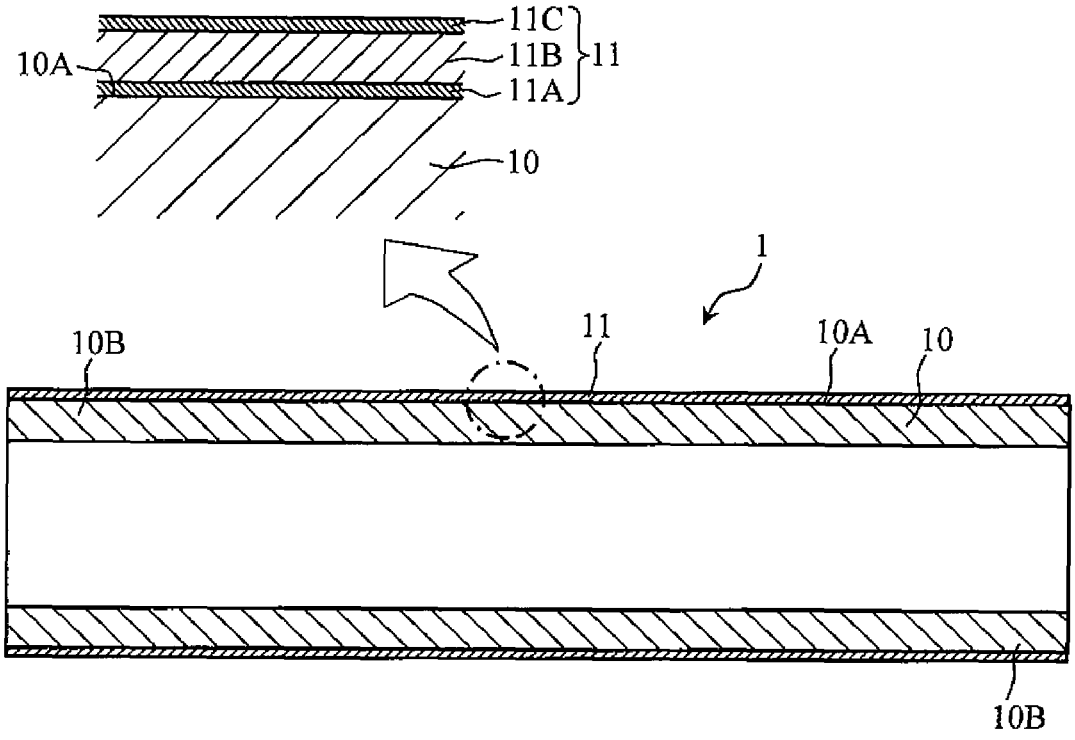
FIG. 1 is a sectional view and an enlarged view of the principal portions, illustrating an example of an electrophotographic photosensitive member according to the present invention.

An electrophotographic photosensitive member 1 illustrated in FIG. 1 includes a cylindrical body 10 having an outer circumferential surface 10A provided with a photosensitive layer 11 which includes an anti-charge injection layer 11A, a photoconductive layer 11B and a surface layer 11C laminated in the order as mentioned above.

The cylindrical body 10 is the main body of the photosensitive member and is conductive at least at the surface. The cylindrical body 10 may be made to be entirely conductive, using a metal material such as aluminum (Al), stainless-steel (SUS), zinc (Zn), copper (Cu), iron (Fe), titanium (Ti), nickel (Ni), chrome (Cr), tantalum (Ta), tin (Sn), gold (Au), and silver (Ag), or an alloy of the above-described metal materials, for example. The cylindrical body 10 may include an insulating body made of resin, glass, or ceramic, on which conductive film is provided using the above-described metal material or a transparent conductive material such as indium tin oxide (ITO) and tin dioxide ($SnO_2$). Among the above-described materials, Al material is most suitable for making the cylindrical body 10, and it is preferable to make the whole cylindrical body 10 of the Al material. In this way, the electrophotographic photosensitive member 1 with reduced weight can be manufactured at low cost. Further, when forming the anti-charge injection layer 11A and the photoconductive layer 11B by a-Si material, the adhesion between the layers and the cylindrical body 10 can be reliably enhanced.

Figure 2A:
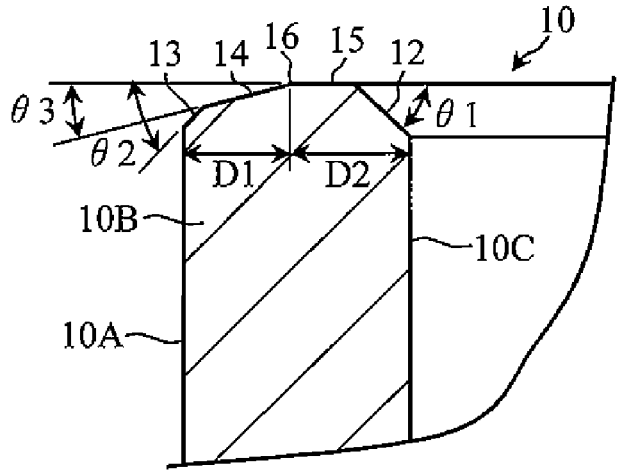
FIG. 2 is a sectional view illustrating end portions of the electrophotographic photosensitive member of FIG. 1.
Figure 2B:
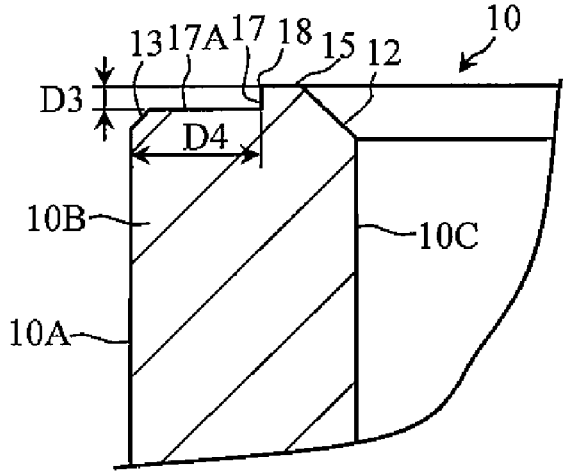
Figure 2C:
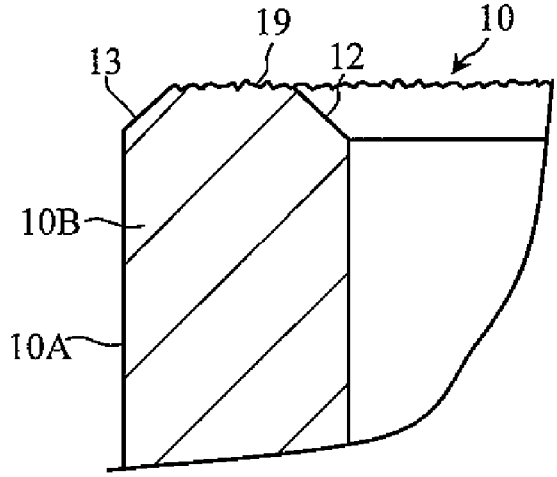

The cylindrical body 10 includes an end portion 10B as shown in FIG. 2A, 2B, or 2C, for example.

In an example shown in FIG. 2A, the end portion 10B is formed with chamfers 12, 13, and 14. The chamfer 12 is arranged adjacent to an end surface 15 and nearer to an inner surface 10C than the end surface 15. The chamfer 12 is formed, for facilitating insertion of a non-illustrated flange, at a crossing angle θ1 of not less than 30° and not more than 60° relative to the end surface 15, for example. The chamfers 13 and 14 are arranged between the end surface 15 and the outer circumferential surface 10A. The chamfer 13 is arranged adjacent to the outer circumferential surface 10A, and formed at a crossing angle θ2 of not less than 30° and not more than 60° relative to the end surface 15, for example. The chamfer 14 is arranged adjacent to the chamfer 13 as well as the end surface 15, and formed at a crossing angle θ3 of not less than 3° and not more than 25° relative to the end surface 15, for example. A boundary 16 between the chamfer 14 and the end surface 15 is positioned at a portion where a shortest distance D1 from the outer circumferential surface 10A is not less than 0.5 mm as seen in the axial direction of the cylindrical body 10. Meanwhile, a width D2 of the end surface 15 (or a shortest distance between the boundary 16 and the inner circumferential surface 10C) is not less than 0.5 mm, or preferably not less than 11.0 mm. When the width D2 of the end surface 15 is less than 0.5 mm, it is difficult to utilize the end surface 15 as a reference surface for attaching the flange to the cylindrical body 10. When the width of the end surface 15 is less than 1 mm, the end surface 15 is likely to be damaged or indented during a manufacturing process in which a pressing force is applied to the end surface 15 of the cylindrical body 10 (when the cylindrical body is set in a jig or stacked within a reacting furnace, for example).

In an example shown in FIG. 2B, the end portion 10B is formed with chamfers 12 and 13 similar to the above example, and a recess 17 in place of the chamfer 14 (see FIG. 2A). The recess 17 has a depth D3 of not less than 0.025 mm and not more than 0.6 mm. A boundary 18 between the recess 17 and the end surface 15 is positioned at a portion where a shortest distance D4 from the outer circumferential surface 10A is not less than 0.5 mm as seen in the axial direction of the cylindrical body 10.

In an example shown in FIG. 2C, the end portion 10B is formed with chamfers 12 and 13 similar to the above examples, and an end surface 19 roughened into pearskin, in place of the end surface 15. The end surface 19 has a surface roughness of not less than 2.0 μm and not more than 4.5 μm in arithmetic mean roughness Ra. The arithmetic mean roughness Ra may be measured in conformity with JIS B 0601-1994.

In the examples shown in FIGS. 2A-2C, one or both of the chamfers 12 and 13 may be omitted.

The anti-charge injection layer 11A shown in FIG. 1 serves to prevent injection of carriers (electrons) from the cylindrical body 10, and is made of amorphous silicon (a-Si) material, for example. Such anti-charge injection layer 11A contains boron (B), nitrogen (N), or oxygen (O) added as a dopant in the a-Si material, and has a thickness of not less than 2 μm and not more than 10 μm.

The photoconductive layer 11B serves to generate carriers by a laser irradiation, and is made of a-Si material or amorphous selenium (a-Se) material such as Se—Te and $As_2Se_3$. In view of obtaining enhanced electrophotographic property (e.g. high photoconductivity, high-speed responsiveness, stable repeatability, high heat resistance, or high endurance) as well as conformity with the surface layer 11C when the surface layer 11C is made of a-Si material, it is preferable that the photoconductive layer 11B is made of a-Si, or a-Si material containing a-Si and carbon (C), nitrogen (N), or oxygen (O). The thickness of the photoconductive layer 11B may be set according to the photoconductive material and desired electrophotographic property. When the photoconductive layer 11B is made of a-Si material, the thickness of the photoconductive layer 11B is set to not less than 5 μm and not more than 100 μm, preferably to not less than 10 μm and not more than 80 μm.

The surface layer 11C serves to protect the surface of the electrophotographic photosensitive member 1, and is made of a-Si material such as amorphous silicon carbide (a-SiC) and amorphous silicon nitride (a-SiN) or of amorphous carbon (a-C), for example, so as to endure scrapes by rubbing in an image forming apparatus. The surface layer 11C has a wide optical band gap for reliably preventing absorption of light such as laser beams emitted to the electrophotographic photosensitive member 1, and also has a resistance (generally not less than $10^{11}$ Ω·cm) enabling to hold an electrostatic latent image in image forming.

Figure 3:
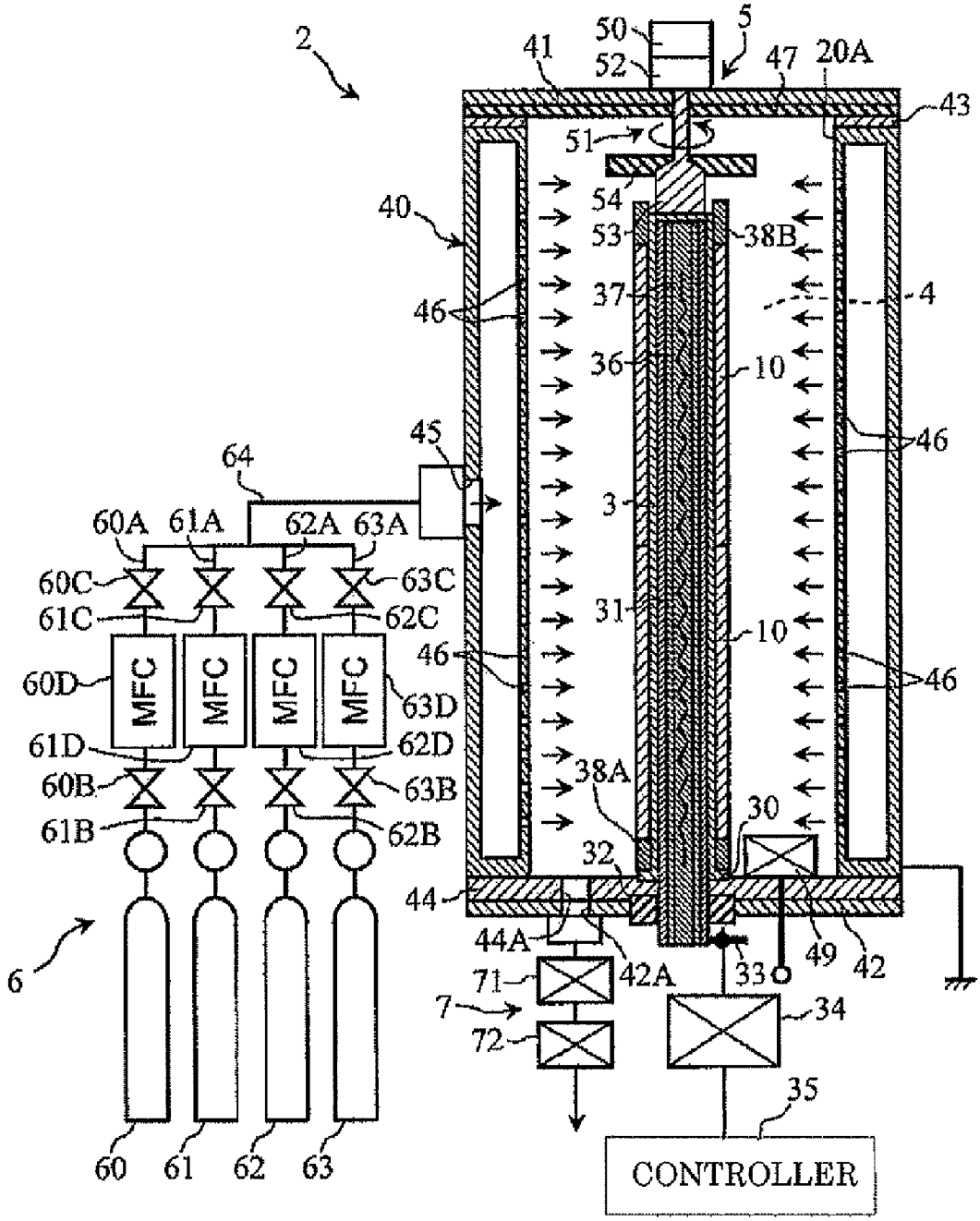
FIG. 3 is a vertical sectional view illustrating an example of a deposited film forming device used in a manufacturing method of the electrophotographic photosensitive member according to the present invention.
Figure 4:
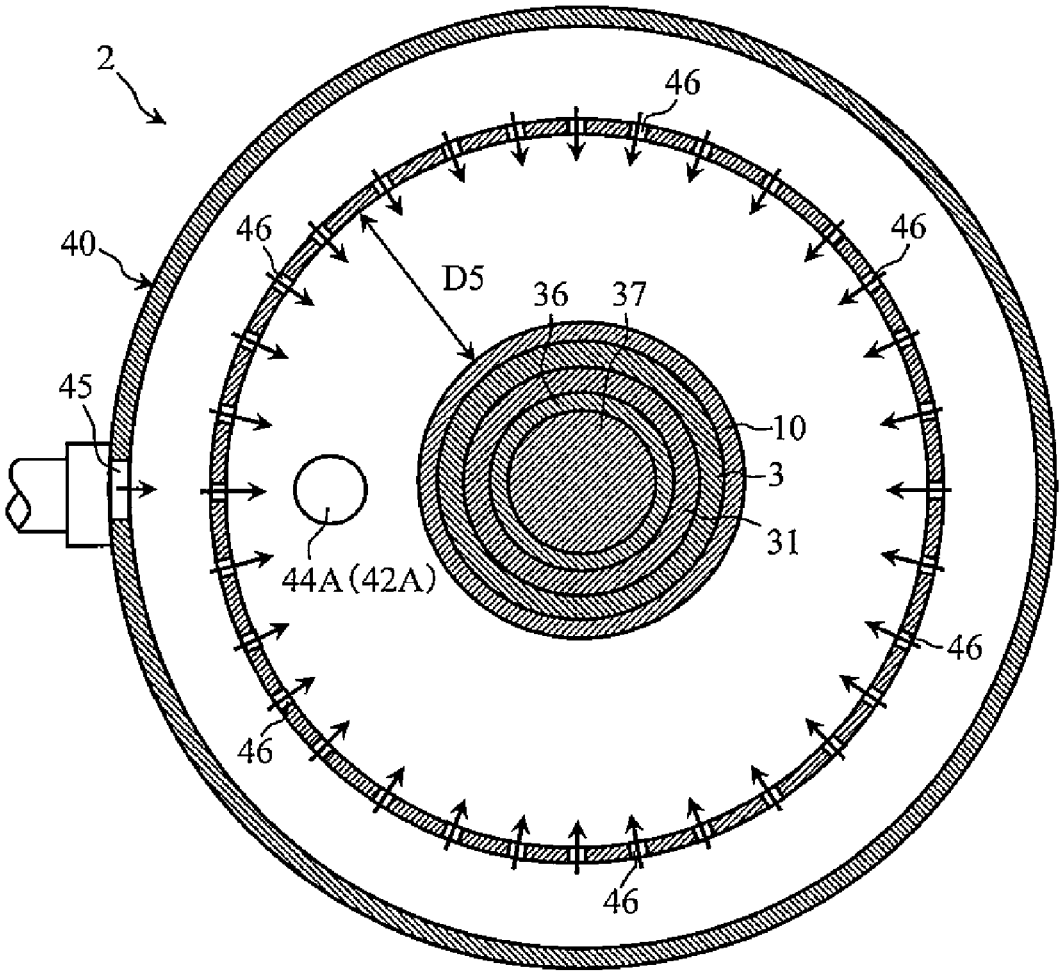
FIG. 4 is a transverse sectional view illustrating the deposited film forming device of FIG. 3.
Figure 5:
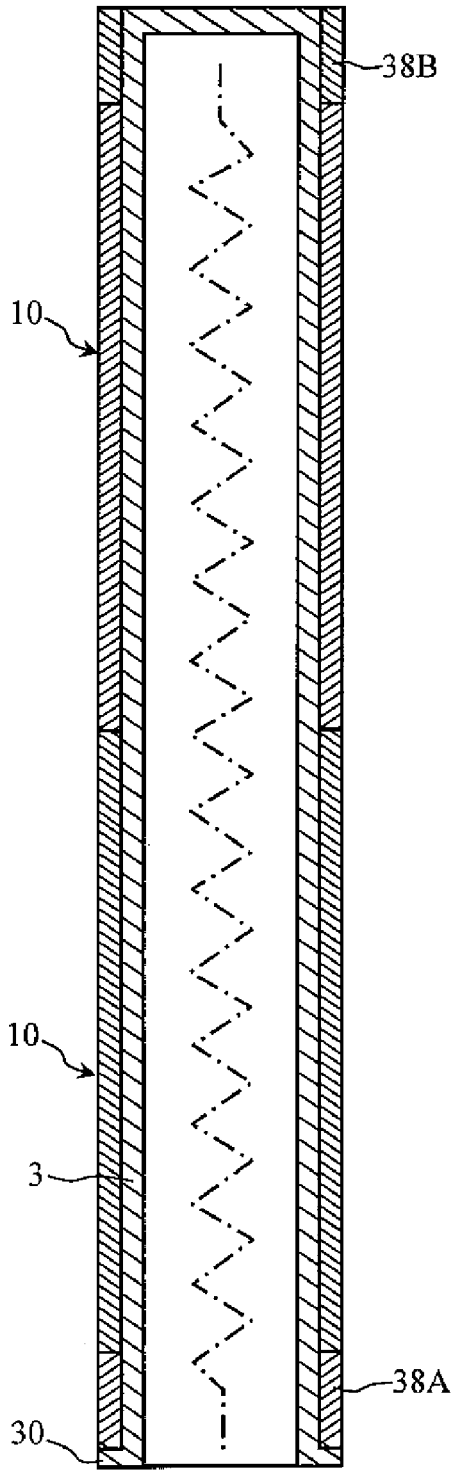
FIG. 5 is a sectional view illustrating the deposited film forming device of FIGS. 3 and 4, supporting two cylindrical bodies at a supporting body.

The anti-charge injection layer 11A, the photoconductive layer 11B, and the surface layer 11C are formed by a plasma CVD device 2 shown in FIGS. 3 and 4, for example.

The plasma CVD device 2 includes a supporting body 3 accommodated in a vacuum reaction chamber 4, a rotation means 5, a material gas supply means 6, and a discharge means 7.

The supporting body 3 supports the cylindrical body 10. The supporting body 3 is a hollow member including a flange portion 30, and made of a conductive material similar to the cylindrical body 10, to be a conductor as a whole. The supporting body 3 has a length long enough for holding two cylindrical bodies 10, and is removable relative to a conductive column 31. Thus, the supporting body 3 enables to insert and extract two cylindrical bodies 10 relative to the vacuum reaction chamber 4 without touching the surfaces of the cylindrical bodies 10.

The conductive column 31 is made of a conductive material similar to the cylindrical body 10 to be a conductor as a whole, and fixed to a plate 42, which is to be described later, via an insulator 32 at the central portion of the vacuum reaction chamber 4 (or a cylindrical electrode 40 which is to be described later).

The conductive column 31 is connected to a DC power source 34 via a conducting board 33. The DC power source 34 is controlled by a controller 35. The controller 35 controls the DC power source 34 to supply Pulse DC voltage to the supporting body 3 via the conductive column 31 (see FIGS. 9 and 10).

The conductive column 31 accommodates a ceramic pipe 36 and a heater 37 in the pipe. The ceramic pipe 36 provides insulating property and heat conductivity. The heater 37 heats the cylindrical body 10. Examples of the heater 37 include nichrome wire and a cartridge heater.

Here, the temperature of the supporting body 3 is monitored by a thermocouple (not shown) attached to the conductive column 31, and based on the monitoring result of the thermocouple, the heater 37 is switched on and off. In this way, the temperature of the cylindrical body 10 is maintained within a predetermined range of not less than 200° C. to not more than 400° C., for example.

The vacuum reaction chamber 4 provides a space for forming deposited film on the cylindrical body 10, and is defined by a cylindrical electrode 40 and a pair of plates 41, 42.

The cylindrical electrode 40 is a cylinder surrounding the supporting body 3. The cylindrical electrode 40 is made of a conductive material similar to the cylindrical body 10 to have a hollow portion, and connected to the paired plates 41, 42 via insulating members 43, 44.

The dimension of the cylindrical electrode 40 is set so that a distance D5 between the cylindrical body 10 held by the supporting body 3 and the cylindrical electrode 40 is made to be not less than 10 mm and not more than 100 mm. This is because if the distance D5 between the cylindrical body 10 and the cylindrical electrode 40 is smaller than 10 mm, the cylindrical body 10 cannot be smoothly inserted and extracted relative to the vacuum reaction chamber 4, and it is difficult to perform stable discharge between the cylindrical body 10 and the cylindrical electrode 40. Meanwhile, if the distance D5 between the cylindrical body 10 and the cylindrical electrode 40 is larger than 100 mm, the dimension of the plasma CVD device 2 is increased and thus the productivity per unit installation area is lowered.

Figure 9:
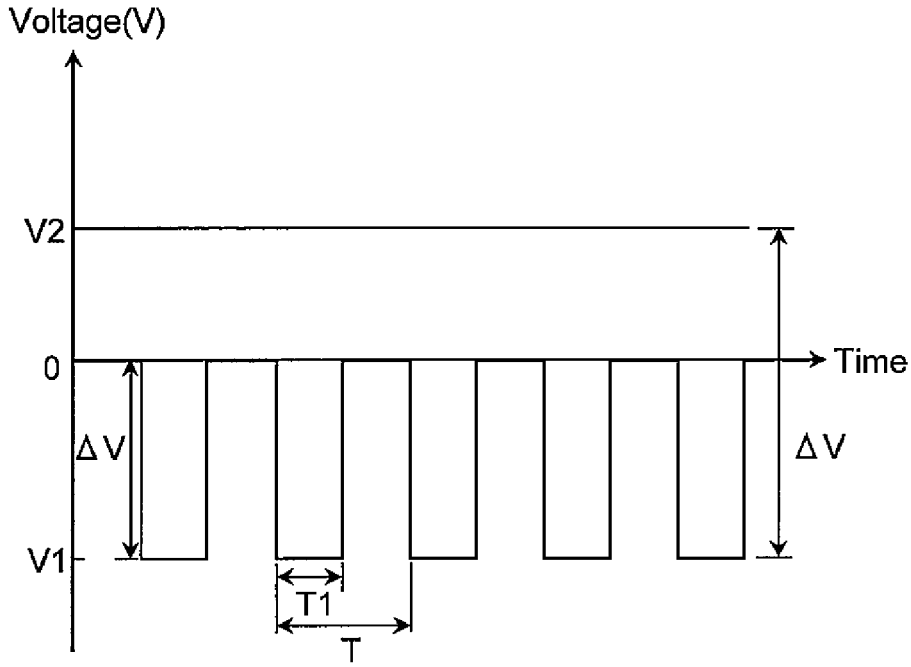
FIG. 9 is a graph illustrating voltage application in the deposited film forming device of FIGS. 3 and 4.
Figure 10:
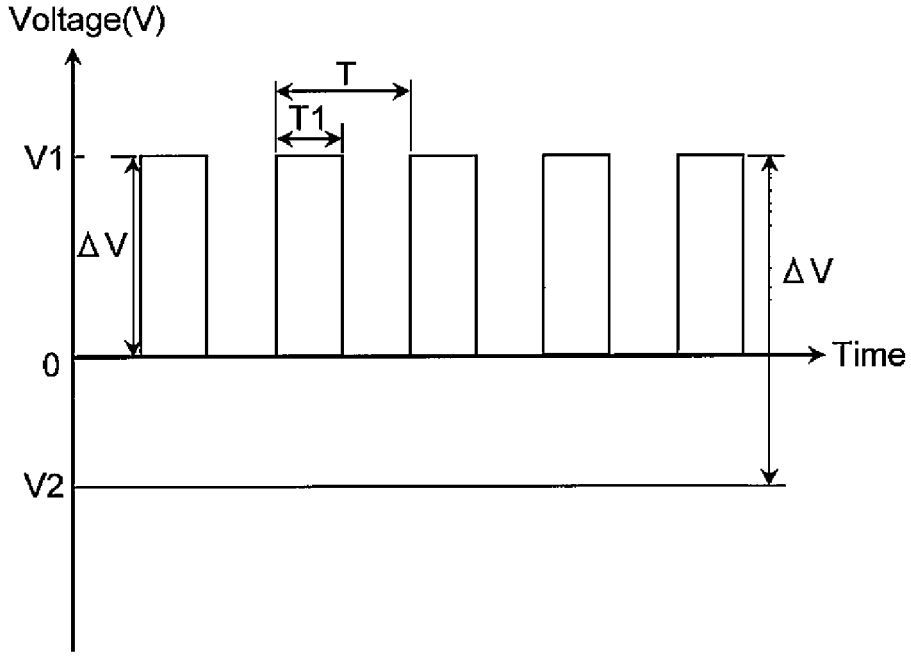
FIG. 10 is a graph illustrating another voltage application in the deposited film forming device of FIGS. 3 and 4.
Figure 11:
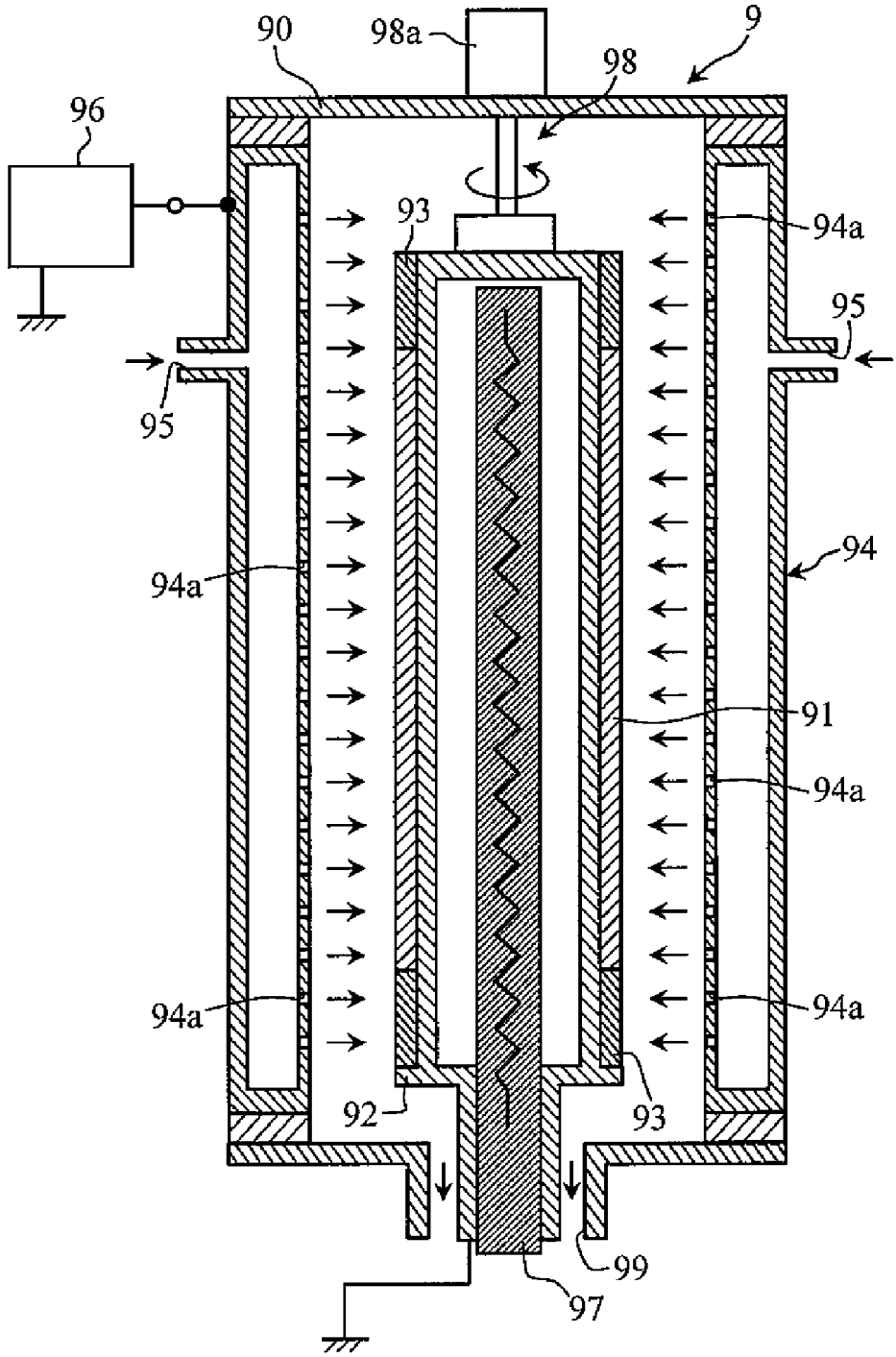
FIG.11 PRIOR ART
FIG. 11 is a sectional view of a CVD device for illustrating an example of a conventional deposited film forming method taking plasma CVD method as an example
Figure 12:
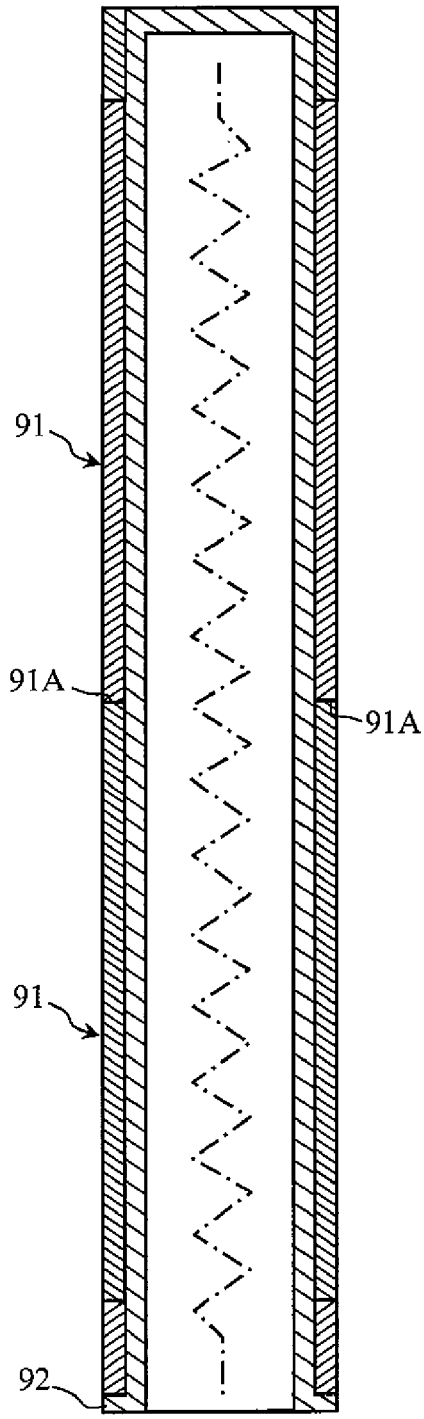
FIG.12 PRIOR ART
FIG. 12 is a sectional view of the CVD device of FIG. 11, supporting two cylindrical bodies at a supporting body.

The cylindrical electrode 40 is provided with a gas inlet port 45 and a plurality of gas outlet ports 46, and grounded at one end. The cylindrical electrode 40 is not necessarily grounded, and may be connected to a reference supply other than the DC power source 34. If the cylindrical electrode 40 is connected to a reference supply other than the DC power source 34, when a negative pulse voltage is applied to the supporting body 3 (or the cylindrical body 10) as shown in FIG. 9, the reference voltage at the reference supply is set to not less than −1500V and not more than 1500V, while when a positive pulse voltage is applied to the supporting body 3 (or the cylindrical body 10) as shown in FIG. 10, the reference voltage is set to not less than −1500V and not more than 1500V.

The gas inlet port 45 serves to introduce the material gas to be supplied to the vacuum reaction chamber 4, and is connected to the material gas supply means 6.

The gas outlet ports 46 serve to spray the material gas introduced into the cylindrical electrode 40 toward the cylindrical body 10, and are arranged at regular intervals in the vertical direction in the figure as well as in the circumferential direction. The gas outlet ports 46 are equally formed into a circle having a diameter of not less than 0.5 mm and not more than 2.0 mm, for example. Of course, the diameter, the shape, and the arrangement of the gas outlet ports 46 may be changed.

The plate 41 enables to select between the opened and closed states of the vacuum reaction chamber 4, and by opening the plate 41, the supporting body 3 can be inserted or extracted relative to the vacuum reaction chamber 4. The plate 41 is made of a conductive material similar to the cylindrical body 10. The plate 41 is provided with a prevention board 47 at the lower surface for preventing deposited film from being formed at the plate 41. The prevention board 47 is also made of a conductive material similar to the cylindrical body 10. The prevention board 47 is removable relative to the plate 41. The prevention board 47 can be washed by removing from the plate 41, and thus used repeatedly.

The plate 42 serves as a base of the vacuum reaction chamber 4, and made of a conductive material similar to the cylindrical body 10. The insulating member 44 is positioned between the plate 42 and the cylindrical electrode 40 to prevent arc discharge from being generated between the cylindrical electrode 40 and the plate 42. Such insulating member 44 is made of a glass material (e.g. borosilicate glass, soda glass, or heat-resistant glass), an inorganic insulating material (e.g. ceramics, quartz, or sapphire), or a synthetic resin insulating material (e.g. fluorine resin such as Teflon®, polycarbonate, polyethylene terephthalate, polyester, polyethylene, polypropylene, polystyrene, polyamide, vinylon, epoxy, mylar, or PEEK (polyether ether ketone)), though not limited to these, and an insulating material may be used, if it has high use temperature and releases only a little gas in vacuum. The insulating member 44 has a thickness larger than a predetermined amount in order to prevent fatal warp due to stress generated by bimetallic effect caused according to inner stress of film and temperature increase in film forming. For example, when making the insulating member 44 using a material having a thermal expansion rate of not less than $3\times10^{-5}$/K and not more than $10\times10^{5}$/K, such as Teflon®, the thickness of the insulating member 44 is set to not less than 10 mm. By setting the thickness of the insulating member 44 to such amount, the degree of warp due to stress generated at the boundary face between the insulating member 44 and a-Si film formed on the surface of the insulating member 44 can be reduced. Specifically, when the a-Si film formed on the insulating member 44 has a thickness of not less than 10 μm and not more than 30 μm, the degree of warp of the insulating member 44 can be set to a difference of not more than 1 mm between the heights at the circumferential edge and at the central portion of the insulating member 44, per 200 mm length of the insulating member 44, as seen in plan view. By reducing the degree of warp of the insulating member 44, the insulating member 44 can be used repeatedly.

The plate 42 and the insulating member 44 are provided with respective gas discharge ports 42A, 44A and a manometer 49. The gas discharge ports 42A, 44A serve to discharge gas from the vacuum reaction chamber 4, and are connected to the discharge means 7. The manometer 49 monitors the pressure in the vacuum reaction chamber 4, and various known manometers can be used.

As shown in FIG. 3, the rotation means 5 serves to rotate the supporting body 3 and includes a rotation motor 50 and a rotation transfer mechanism 51. By rotating the supporting body 3 using the rotation means 5 in film forming, since the cylindrical body 10 is rotated together with the supporting body 3, decomposed components of material gas can be uniformly deposited to the outer circumferential surface of the cylindrical body 10.

The rotation motor 50 serves to provide rotation to the cylindrical body 10. The rotation motor 50 is controlled to rotate the cylindrical body 10 at not less than 1 rpm and not more than 10 rpm. Various known rotation motors can be used as the rotation motor 50.

The rotation transfer mechanism 51 serves to transfer and input the rotation of the rotation motor 50 to the cylindrical body 10, and includes a rotation input terminal 52, an insulating shaft 53, and an insulating board 54.

The rotation input terminal 52 serves to transfer the rotation, while keeping the vacuum state in the vacuum reaction chamber 4. An example of such rotation input terminal 52 includes a vacuum seal such as oil seal and mechanical seal having a double or triple rotation shaft.

The insulating shaft 53 serves to input the rotation from the rotation motor 50 to the supporting body 3, while keeping the insulation between the supporting body 3 and the plate 41, and is made of an insulating material similar to the insulating member 44. Here, the outer diameter of the insulating shaft 53 (or the inner diameter of an upper dummy body 38B which is to be described later) is set to be smaller than the outer diameter of the supporting body 3 during the film forming. Specifically, when the temperature of the cylindrical body 10 in film forming is set to not less than 200° C. to not more than 400° C., the outer diameter of the insulating shaft 53 is set to be smaller than the outer diameter of the supporting body 3 (or the inner diameter of the upper dummy body 38B which is to be described later) by not less than 0.1 mm and not more than 5 mm, preferably by about 3 mm. In order to meet the conditions, when film is not formed (under thermally neutral environment with temperature of not less than 10° C. and not more than 40° C., for example), the difference between the outer diameter of the insulating shaft 53 and the outer diameter of the supporting body 3 (or the inner diameter of the upper dummy body 38B which is to be described later) is set to be not less than 0.6 mm and not more than 5.5 mm.

The insulating board 54 serves to prevent adhesion of foreign objects such as dirt and dust falling from above when attaching or removing the plate 41, and is formed into a circular plate having a diameter larger than the inner diameter of the upper dummy body 38B. The diameter of the insulating board 54 is set to be larger than the diameter of the cylindrical body 10 at a ratio of not less than 1.15 to 1 and not more than 3.0 to 1. When the diameter of the cylindrical body 10 is 30 mm, the diameter of the insulating board 54 is set to about 50 mm, for example.

Such insulating board 54 can prevent foreign objects from adhering to the cylindrical body 10, and thus prevents abnormal electrical discharge due to the foreign objects. Thus, defects in film forming due to adhesion of foreign objects can be prevented and thus the yield of the electrophotographic photosensitive member 1 can be increased. Further, defective image can be prevented in image forming using the electrophotographic photosensitive member 1.

As shown in FIG. 3, the material gas supply means 6 includes a plurality of material gas tanks 60, 61, 62, 63, a plurality of gas pipes 60A, 61A, 62A, 63A, a plurality of valves 60B, 61B, 62B, 63B, 60C, 61C, 62C, 63C, and a plurality of mass flow controllers 60D, 61D, 62D, 63D, and is connected to the cylindrical electrode 40 via a pipe 64 and the gas inlet port 45. The material gas tanks 60-63 are filled with $B_2H_6$, $H_2$ (or He), $CH_4$, or $SiH_4$, for example. The valves 60B-63B, 60C-63C and the mass flow controllers 60D-63D serve to control flow rate, composition, and gas pressure of material gas to be introduced into the vacuum reaction chamber 4. Of course, in the material gas supply means 6, the type of the gas to be filled in the material gas tanks 60-63 and the number of the material gas tanks 60-63 may be selected according to the type or the composition of the film to be formed on the cylindrical body 10.

The discharge means 7 serves to discharge the gas in the vacuum reaction chamber 4 through the gas discharge ports 42A, 44A, and includes a mechanical booster pump 71 and a rotary pump 72. These pumps 71, 72 are controlled according to the monitoring result of the manometer 49. Specifically, with the discharge means 7, based on the monitoring result of the manometer 49, the vacuum state in the vacuum reaction chamber 4 is maintained, and the gas pressure in the vacuum reaction chamber 4 is set to a desired value. The pressure in the vacuum reaction chamber 4 is set to not less than 1.0 Pa and not more than 100 Pa, for example.

Next, a forming method of deposited film using the plasma CVD device is described, exemplifying the electrophotographic photosensitive member 1 (see FIG. 1) in which the cylindrical body 10 is formed with a-Si film.

First, on forming deposited film (a-Si film) on the cylindrical body 10, the plate 41 of the plasma CVD device is removed, and a plurality of cylindrical bodies 10 (two of them are illustrated in the figure) supported by the supporting body 3 are positioned within the vacuum reaction chamber 4, and then the plate 41 is attached.

In supporting the two cylindrical bodies 10 by the supporting body 3, the supporting body 3 is covered by a lower dummy body 38A, the cylindrical body 10, another cylindrical body 10, and an upper dummy body 38B stacked on the flange portion 30 in the mentioned order.

Each of the dummy bodies 38A, 38B are selected from a conductive body or an insulting body provided with a conductive surface, according to use of the photosensitive member to be made, and normally made into cylinders using the same material as the cylindrical body 10.

The lower dummy body 38A adjusts the height of the cylindrical body 10. The upper dummy body 38B prevents deposited film from being formed on the supporting body 3, and also prevents defective film which is caused when the formed film peels off during the film forming. The upper dummy body 38B partly protrudes above the supporting body 3.

As described above, the end portion 10B of the cylindrical body 10 is formed as shown in FIGS. 2A-2C. Thus, when arranging two cylindrical bodies 10 next to each other between the upper dummy body 38B and the lower dummy body 38A, a gap is formed between the end portions 10B of the cylindrical bodies 10.

Figure 6A:
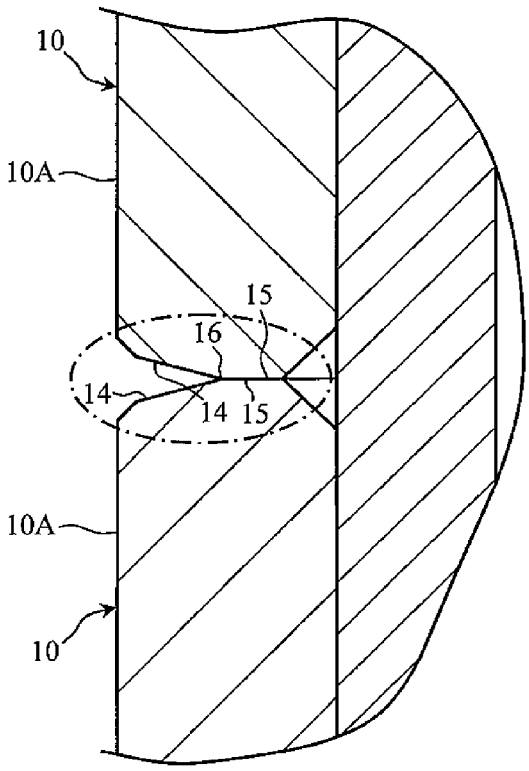
FIG. 6 is a sectional view illustrating the contacting portions of the adjacent cylindrical bodies of FIG. 5.
Figure 6B:
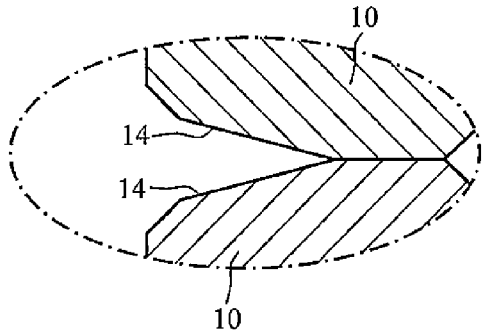
Figure 6C:
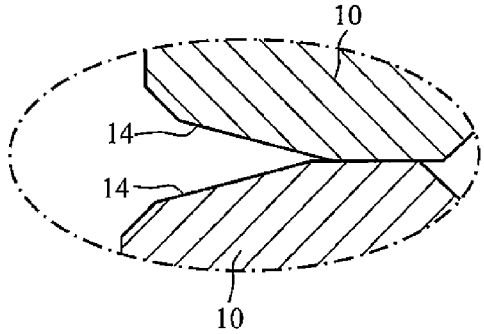

For example, when the cylindrical body 10 as shown in FIG. 2A, specifically, the cylindrical body 10 formed with the chamfer 14 between the outer circumferential surface 10A and the end surface 15 is used, as shown in FIG. 6A, the chamfers 14 of two adjacent cylindrical bodies 10 do not contact each other, and a gap is formed outside of the boundary 16 between the chamfer 14 and the end surface 15. Such gap serves to expose the chamfers 14 in both cases where the adjacent cylindrical bodies 10 are positioned without displacement as shown in FIG. 6B, and where the adjacent cylindrical bodies 10 are positioned with displacement as shown in FIG. 6C.

Figure 7A:
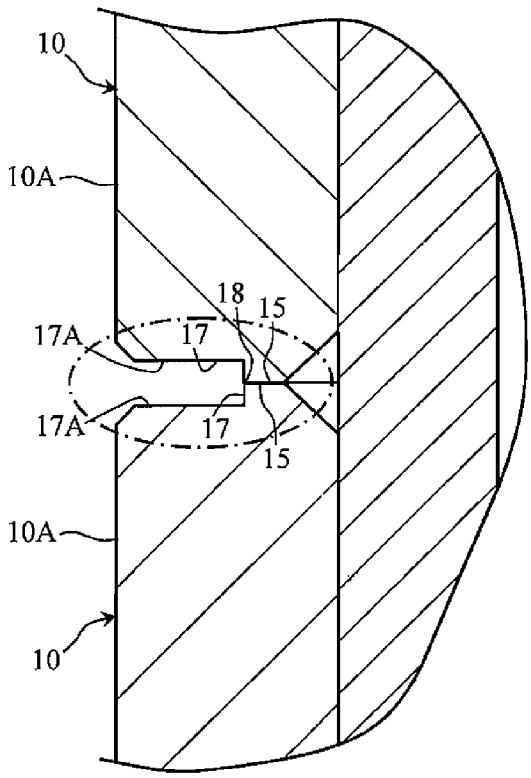
FIG. 7 is a sectional view illustrating the contacting portions of the adjacent cylindrical bodies of FIG. 5.
Figure 7B:
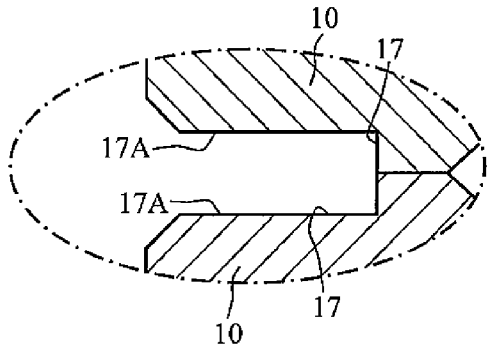
Figure 7C:
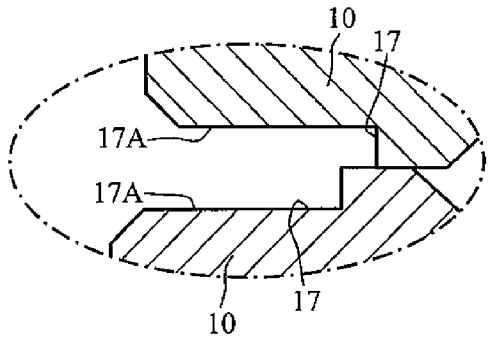

When the cylindrical body 10 as shown in FIG. 2B, specifically, the cylindrical body 10 formed with the recess 17 between the outer circumferential surface 10A and the end surface 15 is used, as shown in FIG. 7A, bottom surfaces 17A of the recesses 17 of the adjacent cylindrical bodies 10 do not contact each other, and a gap is formed outside of the boundary 18 between the recess 17 and the end surface 15. Such gap serves to expose the bottom surfaces 17A of the recesses 17 in both cases where the adjacent cylindrical bodies 10 are positioned without displacement as shown in FIG. 7B, and where the adjacent cylindrical bodies 10 are positioned with displacement as shown in FIG. 7C.

Figure 8A:
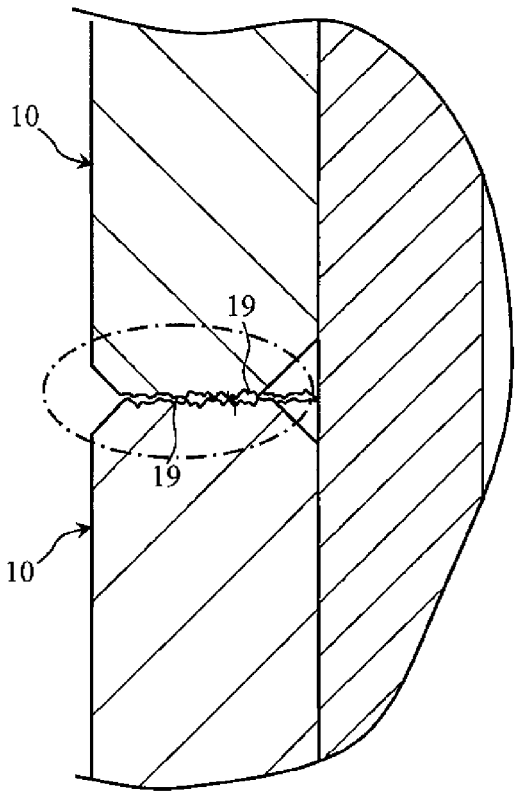
FIG. 8 is a sectional view illustrating the contacting portions of the adjacent cylindrical bodies of FIG. 5.
Figure 8B:
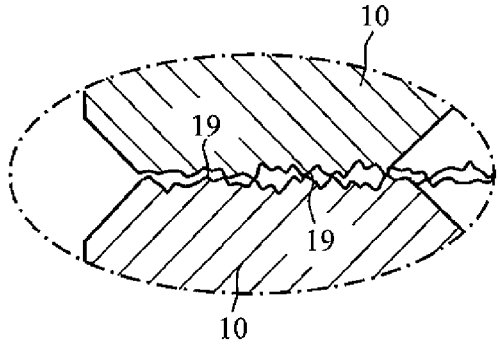
Figure 8C:
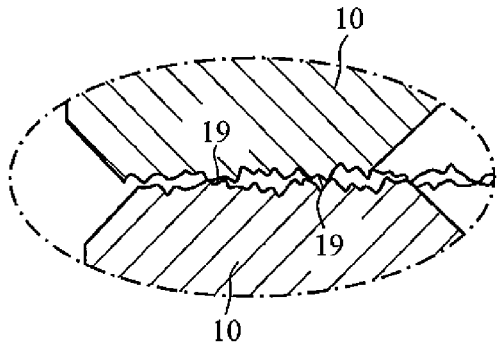

When the cylindrical body 10 as shown in FIG. 2C, specifically, the cylindrical body 10 formed with the end surface 19 roughened into pearskin is used, as shown in FIG. 8A, the end surfaces 19 of the adjacent cylindrical bodies 10 contact each other, still, since the end surfaces 19 of the cylindrical bodies 10 are roughened, a fine gap is formed to allow air flow at the contacting portion. Such gap serves to allow air flow between the end surfaces 19 in both cases where the adjacent cylindrical bodies 10 are positioned without displacement as shown in FIG. 8B, and where the adjacent cylindrical bodies 10 are positioned with a displacement as shown in FIG. 8C.

Next, the vacuum reaction chamber 4 is sealed and the cylindrical body 10 is rotated by the rotation means 5 together with the supporting body 3. Then, the cylindrical body 10 is heated, while the vacuum reaction chamber 4 is decompressed by the discharge means 7.

An external power is supplied to generate heat at the heater 37, and the cylindrical body 10 is heated by the heater 37. Such heat generation at the heater 37 raises the temperature of the cylindrical body 10 to a desired temperature. The temperature of the cylindrical body 10 is selected according to the type and the composition of the film to be formed on the surface of the body. For example, when forming a-Si film, the temperature is set to not less than 250° C. and not more than 300° C., and maintained to be substantially constant by switching the heater 37 on and off.

The vacuum reaction chamber 4 is decompressed by the discharge means 7 which discharges gas from the vacuum reaction chamber 4 through the gas discharge ports 42A, 44A. The pressure in the vacuum reaction chamber 4 is reduced by about $10^{-3}$ Pa, for example, by monitoring the pressure in the vacuum reaction chamber 4 using the manometer 49 (see FIG. 3) and controlling the mechanical booster pump 71 (see FIG. 3) and the rotary pump 72 (see FIG. 3).

Accordingly, when the temperature of the cylindrical body 10 is set to a desired temperature and the pressure in the vacuum reaction chamber 4 is set to a desired pressure, material gas is supplied into the vacuum reaction chamber 4 by the material gas supply means 6, and Pulse DC voltage is applied across the cylindrical electrode 40 and the supporting body 3. Then, a glow discharge is generated between the cylindrical electrode 40 and the supporting body 3 (or the cylindrical body 10), and material gas composition is decomposed, so that the decomposed components of the material gas are deposited on the surface of the cylindrical body 10.

Meanwhile, in the discharge means 7, by monitoring using the manometer 49 and controlling the mechanical booster pump 71 and the rotary pump 72, the gas pressure in the vacuum reaction chamber 4 is maintained within a desired range. The gas pressure in the vacuum reaction chamber 4 is stabilized by the mass flow controllers 60D-63D of the material gas supply means 6 and the pumps 71, 72 of the discharge means 7. The gas pressure in the vacuum reaction chamber 4 is set to not less than 1.0 Pa and not more than 100 Pa, for example.

In supplying material gas to the vacuum reaction chamber 4, by opening and closing the valves 60B-63B, 60C-63C while controlling the mass flow controllers 60D-63D, material gas is introduced at a desired composition and flow rate from the material gas tanks 60-63 into the cylindrical electrode 40 through the pipes 60A-63A, 64 and the gas inlet port 45. The material gas introduced into the cylindrical electrode 40 is sprayed out toward the cylindrical body 10 through the gas outlet ports 46. By changing composition of the material gas using the valves 602-63B, 60C-63C and the mass flow controllers 60D-63D, the outer circumferential surface 10A of the cylindrical body 10 is formed with the anti-charge injection layer 11A, the photoconductive layer 11B, and the surface layer 11C.

Application of the Pulse DC voltage across the cylindrical electrode 40 and the supporting body 3 is performed by controlling the DC power source 34 using the controller 35.

Generally, when high-frequency electricity is applied within the RF band of not less than 13.56 MHz, ion species generated in the air are accelerated by the electric field, and drawn in a direction corresponding to the positive or negative pole. However, since the electric field is continually reversed due to high-frequency AC, the ion species repeat recombination in the air before arriving at the cylindrical body 10 or the discharging electrode, and are discharged as gas or a silicon compound such as polysilicon powder.

On the other hand, when applying Pulse DC voltage to the cylindrical body 10 to have positive or negative polarity, cations are accelerated to bump into the cylindrical body 10, and the impact of the bump can be used for sputtering fine irregularities at the surface of the body while forming a-Si film. In this way, a-Si film having a surface with very little irregularities can be obtained. The inventor named this phenomenon as "ion sputtering effect".

In such plasma CVD method, in order to efficiently obtain the ion sputtering effect, it is necessary to apply electric power in a manner that continual reversal of polarity is prevented, for which triangular wave, DC power, and DC voltage is usable in addition to the above pulse rectangular wave. Further, AC power can be also used if the whole voltage is adjusted to have either of positive and negative polarity. The polarity of the applied voltage can be freely changed in consideration of film forming rate which depends on ion species density and polarity of deposited species, corresponding to the type of material gas.

Further, in order to efficiently obtain the ion sputtering effect utilizing pulse voltage, potential difference between the supporting body 3 (or the cylindrical body 10) and the cylindrical electrode 40 is set to not less than 50V and not more than 3000V, for example, and in consideration of the forming rate, it is preferable to set the potential difference to not less than 500V and not more than 3000V.

Specifically, when the cylindrical electrode 40 is grounded, the controller 35 supplies negative pulse DC potential V1 in the range of not less than −3000V to not more than −50V (see FIG. 9), or positive pulse DC potential V1 in the range of not less than 50V to not more than 3000V (see FIG. 10), to the supporting body 3 (or the conductive column 31).

When the cylindrical electrode 40 is connected to the reference supply (not shown), the pulse DC potential V1 to be supplied to the supporting body (or the conductive column 31) is a value (ΔV-V2) obtained by subtracting electrical potential V2 supplied by the reference supply from a desired electrical potential difference ΔV. When negative pulse voltage is applied to the supporting body 3 (or the cylindrical body 10) as shown in FIG. 9, the electrical potential V2 supplied by the reference supply is set to be in the range of not less than −1500V to not more than 1500V, while when positive pulse voltage is applied to the supporting body 3 (or the cylindrical body 10) as shown in FIG. 10, the electrical potential V2 is set to be in the range of not less than −1500V to not more than 1500V.

The controller 35 also serves to set frequency of DC voltage (1/T (sec)) to not more than 300 kHz, and duty ratio (T1/T) to not less than 20% and not more than 90%, by controlling the DC power source 34.

Here, the duty ratio in the present invention is defined as a ratio of potential difference generating time T1 to one period (T) of pulse DC voltage (period from the moment potential difference is generated across the cylindrical body 10 and the cylindrical electrode 40 to the moment the next potential difference is generated). For example, when the duty ratio is 20%, the potential difference generating time (ON time) T1 in one period accounts for 20% of the one period T in pulse voltage application.

By utilizing the ion sputtering effect in forming the a-Si photoconductive layer 11B, even if the thickness of the layer is not less than 10 μm, fine irregularities at the surface are finer and the smoothness is hardly deteriorated. Thus, when a-SiC film is laminated on the photoconductive layer 11B to form the surface layer 11C, the surface of the surface layer 11C can be a smooth surface benefiting from the smoothness of the photoconductive layer 11B. Further, by utilizing the ion sputtering effect in forming the surface layer 11C, the surface layer 11C can also have a smooth surface with finer irregularities.

As described above, in forming the anti-charge injection layer 11A, the photoconductive layer 11B, and the surface layer 11C, the mass flow controllers 60D-63D and the valves 60B-63B, 60C-63C of the material gas supply means 6 are controlled to supply material gas with desired composition to the vacuum reaction chamber 4.

For example, when forming the anti-charge injection layer 11A as a-Si deposited film, the material gas may be Si-containing gas such as $SiH_4$ (silane gas), dopant-containing gas such as $B_2H_6$, or mixed gas of diluent gases such as hydrogen ($H_2$) and helium (He). Examples of the dopant-containing gas may include, in addition to boron-containing gas (B) nitrogen (N) and oxygen (O).

When forming the photoconductive layer 11B as a-Si deposited film, the material gas may be Si-containing gas such as $SiH_4$ (silane gas) or mixed gas of diluent gases such as helium (He). In forming the photoconductive layer 11B, hydrogen gas may be used as the diluent gas or a halogen compound may be contained in the material gas, so that hydrogen (H) or a halogen element (F, Cl) may be contained in the film by not less than one atom % and not more than 40 atom % for dangling-bond termination. Further, for obtaining a desired property such as electrical property including e.g. dark conductivity and photoconductivity as well as optical bandgap, the material gas may contain a thirteenth group element of the periodic system (hereinafter referred to as "thirteenth group element") or a fifteenth group element of the periodic system (hereinafter referred to as "fifteenth group element") or carbon (C) or oxygen (O) may be also contained.

As the thirteenth group element and the fifteenth group element, it is desired to use boron (B) and phosphorus (P) in view of high covalence and sensitive change of semiconductor property, as well as of high luminous sensitivity. When the thirteenth group element and the fifteenth group element are contained in combination with elements such as carbon (C) and oxygen (O) in forming the anti-charge injection layer 11A, preferably, the thirteenth group element may be contained by not less than 0.1 ppm and not more than 20000 ppm, while the fifteenth group element may be contained by not less than 0.1 ppm and not more than 10000 ppm. Further, when the thirteenth group element and the fifteenth group element are contained in combination with elements such as carbon (C) and oxygen (O) in forming the photoconductive layer 11B, or when elements such as carbon (C) and oxygen (O) are not contained in forming the anti-charge injection layer 11A and the photoconductive layer 11B, the thirteenth group element may be contained by not less than 0.01 ppm and not more than 200 ppm, while the fifteenth group element may be contained by not less than 0.01 ppm and not more than 100 ppm. The amount of the thirteenth group element and the fifteenth group element contained in the material gas may be changed with time so that concentration gradient is generated in the film thickness. In this case, the amount of the thirteenth group element and the fifteenth group element in the photoconductive layer 11B is set so that the average content in the photoconductive layer 11B is within the above-described range.

In forming the photoconductive layer 11B using a-Si material, microcrystal silicon (μc-Si) may be contained, which enhances dark conductivity and photoconductivity, and thus advantageously increases design freedom of the photoconductive layer 11B. Such μc-Si can be formed by utilizing a method similar to the above-described method, and by changing film forming conditions. For example, when utilizing glow discharge decomposition method, the layer can be formed by setting the temperature and pulse DC electric power at the cylindrical body 10 to be relatively high, and by increasing flow amount of hydrogen as diluent gas. Further, elements similar to the above-described elements (the thirteenth group element and the fifteenth group element, carbon (C), and oxygen (O)) may also be added when forming the photoconductive layer 11B containing μc-Si.

When forming the surface layer 11C as a-SiC deposited film, the material gas may be Si-containing gas such as $SiH_4$ (silane gas) and mixed gas of C containing gases such as $CH_4$. The component ratio of Si to C in the material gas may be changed continuously or intermittently. Specifically, since the forming rate tends to be lowered as the ratio of C is increased, in forming the surface layer 11C, the ratio of C is reduced at a region of the surface layer 11C near the photoconductive layer 11B, whereas the ratio of C is increased at the side of the free surface. For example, the surface layer 11C may have a double-layered structure by depositing a first SiC layer, on the photoconductive layer 11B (or the boundary surface), containing relatively large amount of Si in which the value X (carbon atom ratio) in amorphous hydrogenated silicon carbide ($a\text{-}Si_{1-X}C_X$:H) is set to more than 0 and less than 0.8, and then forming thereon a second SiC layer containing an increased amount of C in which the value X (carbon atom ratio) is set to not less than 0.95 and less than 1.0.

The thickness of the first SiC layer is determined in consideration of pressure resistance, residual potential, and strength of film, to be normally not less than 0.1 μm and not more than 2.0 μm, preferably not less than 0.2 μm and not more than 10 μm, and most preferably, not less than 0.3 μm and not more than 0.8 μm. The thickness of the second SiC layer is determined in consideration of pressure resistance, residual potential, strength of film, and life period (wear resistance), to be normally not less than 0.01 μm and not more than 2.0 μm, preferably not less than 0.02 μm and not more than 0.8 μm, and most preferably, not less than 0.05 μm and not more than 0.8 μm.

The surface layer 11C may be formed as a-C layer as described above. In this case, the material gas is C containing gas such as $C_2H_2$ (acethylene gas) and $CH_4$ (methane gas). Such surface layer 11C has a thickness of normally not less than 0.1 μm and not more than 2.0 μm, preferably not less than 0.2 μm and not more than 1.0 μm, and most preferably, not less than 0.3 μm and not more than 0.8 μm.

When the surface layer 11C is formed as a-C layer, since the binding energy of C—O binding is larger than Si—O binding, oxidization of the surface of the surface layer 11C is more reliably prevented than when the surface layer 11C is formed of a-Si material. Specifically, when the surface layer 11C is formed as a-C layer, since e.g. ozone is generated by corona discharge during printing, oxidization of the surface of the surface layer 11C is suitably prevented, thereby preventing image deletion due to the environment with high temperature and humidity.

When the film forming of the cylindrical body 10 is finished, the cylindrical body 10 is removed from the supporting body 3, and the electrophotographic photosensitive member 1 shown in FIG. 1 is obtained. After the film forming, in order to remove residues, members of the vacuum reaction chamber 4 are disassembled and undergo acid cleaning, alkali cleaning, or blast cleaning. Then, wet etching is performed to prevent generation of dust which may cause a defect in the next film forming. In place of wet etching, gas etching may be performed using a halogen gas ($ClF_3$, $CF_4$, $NF_3$, $SiF_6$ or mixed gas of these gases) or $O_2$ gas.

As described above, a gap is formed between the adjacent cylindrical bodies 10, and the air existing around the cylindrical body 10 flows into the gap. Thus, when forming deposited film on the outer circumferential surface 10A of the cylindrical body 10, decomposed components of the material gas flow into the gap between the cylindrical bodies 10, and are deposited on the surfaces defining the gap. As a result, at the cylindrical body 10, deposited film is continuously formed from the outer circumferential surface 10A to the chamfers 13 and 14, the bottom surface 17A of the recess 17, or pearskin of the end surface 19. Therefore, in forming deposited film on the cylindrical body 10, the end portion of the cylindrical body 10 is prevented from adhesion of powdered deposited material which forms fine projections, and thus the deposited film is prevented from peeling off from the end portion 10B of the cylindrical body 10. Further, by continuously forming the deposited film from the outer circumferential surface 10A to the chamfers 13 and 14, the bottom surface 17A of the recess 17, or pearskin of the end surface 19, the adhesion between the film and the end portion 10B of the cylindrical body 10 can be reliably enhanced. Accordingly, when removing the cylindrical body 10 from the supporting body 3, the film is prevented from peeling off from the end portion 10B of the cylindrical body 10. In this way, in the present invention, fine projections are prevented from being formed on the cylindrical body 10, and the film is prevented from peeling off at the end portion 10B of the cylindrical body 10. As a result, it is able to increase the yield and reduce the product cost of the electrophotographic photosensitive member 1.

Example 1

In the present example, it was studied how the crossing angle θ3 of the chamfer 14 relative to the end surface 15 affects generation of fine projections, when forming deposited film on the cylindrical body shown in FIG. 2A.

Deposited film was formed on the outer circumferential surface 10A of the cylindrical body 10, using the plasma CVD device 2 shown in FIGS. 3 and 4, by applying negative pulse DC voltage (see FIG. 9) across the cylindrical body 10 (or the supporting body 3) and the cylindrical electrode 40. The cylindrical body 10 was made of A5052 aluminum alloy drawn tube (outer diameter: 30 mm, wall thickness: 2.5 mm, and length: 340 mm), by performing a predetermined cutting process using a lathe to the end portions and then degreasing. In the present example, the dummy bodies 38A, 38B were used to stack two cylindrical bodies 10 in the axial direction of the supporting body 3. In the plasma CVD device 2, the distance D5 between the cylindrical body 10 and the cylindrical electrode 40 was set to 25 mm and the cylindrical electrode 40 was grounded. The forming conditions were set as shown in the following Table 1. The rotation speed of the cylindrical body 10 in film forming was set to 10 rpm.

TABLE 1

| Layers | | Anti-charge Injection Layer | Photoconductive Layer | Surface Layer |
|---|---|---|---|---|
| Material Gas | $SiH_4$ [sccm] | 170 | 340 | 30 |
| | $H_2$ [sccm] | 200 | 200 | 0 |
| | $B_2H_6$ [sccm] | 1150 | 0.3 | 0 |
| | $CH_4$ [sccm] | 0 | 0 | 600 |

TABLE 1-continued

| Layers | Anti-charge Injection Layer | Photoconductive Layer | Surface Layer |
|---|---|---|---|
| Gas Pressure [Pa] | 80 | 80 | 86.5 |
| Temperature of Body [° C.] | 300 | 320 | 250 |
| DC Voltage [V] | −665 | −735 | −280 |
| Pulse Frequency [kHz] | 30 | 30 | 30 |
| Duty Ratio [%] | 50 | 50 | 50 |
| Film Thickness [μm] | 5 | 14 | 1 |

The crossing angle θ3 at the cylindrical body 10 was changed and generation of fine projections was checked visually. The results are shown in the following Table 2. Here, the cylindrical body was formed to have D1=1.0 mm, chamfer 12 of C0.5 (crossing angle θ1=45°, length 0.5 mm), and chamfer 13 of C0.2 (crossing angle θ2=45°, length 0.2 mm).

TABLE 2

| | Crossing Angle θ3 | | | | | |
|---|---|---|---|---|---|---|
| | 0° | 3° | 10° | 20° | 25° | 30° |
| Evaluation | X | ◎ | ◎ | ◎ | ○ | X |

◎: There were no or very few fine projections, and no problem in practical use.
○: There were some fine projections, but no problem in practical use.
X: There were a number of fine projections, and problem in practical use.

As can be seen from Table 2, when the chamfer 14 was not formed (θ3=0°) and when the chamfer 14 had a crossing angle θ3 of 30°, a number of fine projections were generated and might cause problem in practical use. When the chamfer 14 had a crossing angle θ3 of 25°, some fine projections were generated, though without problem in practical use. On the other hand, when the chamfer 14 had a crossing angle θ3 of not less than 3° and not more than 20°, no or very little fine projections were generated and might cause no problem in practical use. Thus, in view of preventing generation of fine projections, it is preferable to set the crossing angle θ3 of the chamfer 14 to not less than 3° and not more than 25°.

Example 2

In the present example, it was studied how the distance D1 between the boundary 16 and the outer circumferential surface 10A, as seen in the axial direction, affects the generation of fine projections, when forming deposited film on the cylindrical body shown in FIG. 2A.

Forming of deposited film on the cylindrical body 10 and checking of fine projections were performed similarly to the Example 1. The results are shown in the following Table 3. In the present example, the chamfers 12 and 13 were omitted.

TABLE 3

| | Distance D1 [mm] | | | | | |
|---|---|---|---|---|---|---|
| | 0 | 0.2 | 0.5 | 1.5 | 2.0 | 2.4 |
| Evaluation | X | X | ◎ | ◎ | ◎ | ◎ |

◎: There were no or very few fine projections, and no problem in practical use.
X: There were a number of fine projections, and problem in practical use.

As can be seen from Table 3, when the distance D1 between the boundary 16 and the outer circumferential surface 10A was not more than 0.2 mm, a number of projections were generated and might cause problem in practical use. On the other hand, when the distance D1 between the boundary 16 and the outer circumferential surface 10A was not less than 0.5 mm, no or very little fine projections were generated, and might cause no problem in practical use. Thus, in view of preventing generation of fine projections, it is preferable to set the distance D1 between the boundary 16 and the outer circumferential surface 10A to not less than 0.5 mm.

Example 3

In the present example, it was studied how the depth D3 formed between the end surface and the outer circumferential surface affects the generation of fine projections, when forming deposited film on the cylindrical body shown in FIG. 2B.

The cylindrical body 10 was formed by cutting the end portion of the cylindrical body 10 as shown in FIG. 2B. Here, the cylindrical body was formed to have D4=1.0 mm, which is the shortest distance from the outer circumferential surface 10A to the boundary 18 between the recess 17 and the end surface 15, inner chamfer 12 of C0.5, and outer chamfer 13 of C0.2. Forming of deposited film on the cylindrical body 10 and checking of fine projections were performed similarly to the Example 1. The results are shown in the following Table 4.

TABLE 4

| | Distance D3 [mm] | | | | | |
|---|---|---|---|---|---|---|
| | 0 | 0.025 | 0.1 | 0.2 | 0.6 | 1.0 |
| Evaluation | X | ◎ | ◎ | ◎ | ○ | X |

◎: There were no or very few fine projections, and no problem in practical use.
○: There were some fine projections, but no problem in practical use.
X: There were a number of fine projections, and problem in practical use.

As can be seen from Table 4, when no recess was formed between the end surface and the outer circumferential surface of the cylindrical body 10 (D3=0), a number of projections were generated and might cause problem in practical use. Further, when the depth D3 of the recess was 1 mm, a number of projections were generated and might cause problem in practical use. When the depth D3 of the recess was 0.6 mm, some fine projections were generated though without problem in practical use. On the other hand, when the depth D3 of the recess was not less than 0.025 mm and not more than 0.2 mm, no or very little fine projections were generated and might cause no problem in practical use. Thus, in view of preventing generation of fine projections, it is preferable to set the depth D3 of the recess formed between the end surface and the outer circumferential surface to not less than 0.025 mm and not more than 0.6 mm.

Example 4

In the present example, it was studied how the distance D4 between the boundary 18 and the outer circumferential surface 10A, as seen in the axial direction, affects the generation of fine projections, when forming deposited film on the cylindrical body shown in FIG. 2B.

Forming of deposited film on the cylindrical body 10 and checking of fine projections were performed similarly to the Example 3. Here, the cylindrical body was formed to have a recess between the end surface and the outer circumferential surface with a depth D3 of 0.1 mm, while the inner chamfer 12 and the outer chamfer 13 were omitted. The results are shown in the following Table 5.

TABLE 5

| | Distance D4 [mm] | | | | | |
|---|---|---|---|---|---|---|
| | 0 | 0.2 | 0.5 | 1.5 | 2.0 | 2.2 |
| Evaluation | X | X | ◎ | ◎ | ◎ | ◎ |

◎: There were no or very few fine projections, and no problem in practical use.
X: There were a number of fine projections, and problem in practical use.

As can be seen from Table 5, when the distance D4 between the boundary 18 and the outer circumferential surface 10A was not more than 0.2 mm, a number of projections were generated and might cause problem in practical use. On the other hand, when the distance D4 between the boundary 18 and the outer circumferential surface 10A was not less than 0.5 mm, no or very little fine projections were generated and might cause no problem in practical use. Further, when the distance D4 was 2.2 mm, no fine projection was generated, however, since the area of the end surface 15 was reduced, there was deviation in attaching the flange. In view of preventing generation of fine projections, it is preferable to set the distance D4 between the boundary 18 and the outer circumferential surface 10A to not less than 0.5 mm. However, considering that the flange is attached in mounting to an image forming apparatus, it is preferable that the length of the end surface is not less than 0.5 mm. Since the wall thickness of the cylindrical body 10 was 2.5 mm, when the length of the end surface of the cylindrical body 10 was not more than 2.0 mm, preferable results were obtained.

Example 5

In the present example, it was studied how the end surface roughened to have pearskin affects the generation of fine projections, when forming deposited film on the cylindrical body shown in FIG. 2C.

The cylindrical body 10 was made by cutting the end portion of the cylindrical body 10 and then performing shot blast process to the end surface 19 as shown in FIG. 2C. The cylindrical body was formed to have inner chamfer 12 of C0.5 and outer chamfer 13 of C0.2. The arithmetic surface roughness Ra (in conformity with JIS B 0601-1994) at the end surface 19 of the cylindrical body 10 was changed within the rage shown in the following Table 6, and generation of fine projections were checked visually. The results are shown in the following Table 6.

TABLE 6

| | Surface Roughness Ra [μm] | | | | | |
|---|---|---|---|---|---|---|
| | 0.5 | 1.0 | 2.0 | 3.0 | 4.5 | 5.5 |
| Evaluation | X | X | ◎ | ◎ | ◎ | ◎ |

◎: There were no or very few fine projections, and no problem in practical use.
X: There were a number of fine projections, and problem in practical use.

As shown Table 6, when the surface roughness Ra at the cylindrical body 10 was 0.5 μm, in which the end surface 19 had no pearskin, a number of projections were generated and might cause problem in practical use. Further, when the surface roughness Ra was 1.0 μm, in which the end surface 19 had pearskin, a number of projections were generated and might cause problem in practical use. When the surface roughness Ra was not less than 2.0 μm and not more than 4.5 μm, in which the end surface had pearskin, no or very little fine projections were generated and might cause no problem in practical use.

When the surface roughness Ra was 5.5 μm, in which the end surface 19 had pearskin, though no fine projection was generated, due to the large roughness at the end surface 19, there was deviation in attaching the flange. Thus, in view of preventing generation of fine projections, it is preferable to set the arithmetic surface roughness Ra at the end surface 19 to not less than 2.0 μm. Further, considering that the flange is attached in mounting to an image forming apparatus, it is preferable to set the arithmetic surface roughness Ra at the end surface 19 to not more than 4.5 μm.

The invention claimed is:

1. An electrophotographic photosensitive member comprising:

a cylindrical body; and a deposited film comprising a photosensitive layer formed on an outer circumferential surface of the cylindrical body, wherein the cylindrical body includes a plurality of chamfers connected to each other, formed between an end surface and the outer circumferential surface, wherein one of the plurality of chamfers which is adjacent to the end surface of the cylindrical body, has a crossing angle of not less than 3° and not more than 25° relative to the end surface, wherein a portion of the deposited film is formed from the outer circumferential surface to the plurality of chamfers.

2. The electrophotographic photosensitive member according to claim 1, wherein a boundary between the chamfer and the end surface is set in a position where a shortest distance from the outer circumferential surface of the cylindrical body, as seen in the axial direction, is not less than 0.5 mm.

3. An electrophotographic photosensitive member comprising:

a cylindrical body; and a deposited film comprising a photosensitive layer formed on an outer circumferential surface of the cylindrical body, wherein the cylindrical body includes a recess having a first inner surface adjacent to an end surface and a second inner surface adjacent to the first inner surface, and the recess is between the end surface and the outer circumferential surface, wherein the first inner surface is parallel to the outer circumferential surface, and the second inner surface is parallel to the end surface, and wherein a portion of the deposited film is formed from the outer circumferential surface to the recess.

4. The electrophotographic photosensitive member according to claim 3, wherein a distance between the end surface and the first inner surface is not less than 0.025 mm and not more than 0.6 mm.

5. The electrophotographic photosensitive member according to claim 3, wherein a distance between the outer circumferential surface and the second inner surface, as seen in the axial direction of the cylindrical body, is not less than 0.5 mm.

6. The electrophotographic photosensitive member according to claim 3, wherein the cylindrical body further includes a chamfer formed between the second inner surface and the outer circumferential surface.

7. A method of manufacturing a plurality of electrophotographic photosensitive members, comprising:

a first step of supporting a plurality of cylindrical bodies by a supporting body; and a second step of forming a deposited film, wherein the deposited film comprises a photosensitive layer on an outer circumferential surface of each cylindrical body, wherein each of the cylindrical bodies includes a recess having a first inner surface adjacent to an end surface and a second inner surface adjacent to the first inner surface, wherein the first inner surface is parallel to the outer circumferential surface, and the second inner surface is parallel to the end surface, wherein in the first step, the cylindrical bodies are supported by the supporting body in a manner that the recesses are positioned at contacting portions of adjacent cylindrical bodies, and wherein in the second step, a portion of the deposited film is formed from the outer circumferential surface to the second inner surface.

8. The manufacturing method of the plurality of electrophotographic photosensitive members according to claim 7, wherein a distance between the end surface and the second inner surface is not less than 0.025 mm and not more than 0.6 mm.

9. The manufacturing method of the plurality of electrophotographic photosensitive members according to claim 7, wherein a distance between the outer circumferential surface and the second inner surface as seen in the axial direction of the cylindrical body is not less than 0.5 mm.

10. The manufacturing method of the plurality of electrophotographic photosensitive members according to claim 7, wherein each of the cylindrical bodies further includes a chamfer formed between the second inner surface and the outer circumferential surface.

* * * * *